US011117791B2

(12) United States Patent
Alipour et al.

(10) Patent No.: US 11,117,791 B2
(45) Date of Patent: Sep. 14, 2021

(54) JAR SEALING AND UNSEALING DEVICE

(71) Applicants: Ehsan Alipour, San Rafael, CA (US); Joseph Benjamin Strecker, Half Moon Bay, CA (US); Wesley Scott, Danville, CA (US)

(72) Inventors: Ehsan Alipour, San Rafael, CA (US); Joseph Benjamin Strecker, Half Moon Bay, CA (US); Wesley Scott, Danville, CA (US)

(73) Assignee: Unovo LLC.

( * ) Notice: Subject to any disclaimer, the term of this patent is extended or adjusted under 35 U.S.C. 154(b) by 299 days.

(21) Appl. No.: 15/913,571

(22) Filed: Mar. 6, 2018

(65) Prior Publication Data

US 2018/0251355 A1 Sep. 6, 2018

Related U.S. Application Data

(60) Provisional application No. 62/467,424, filed on Mar. 6, 2017.

(51) Int. Cl.
*B67B 3/24* (2006.01)
*B67B 7/20* (2006.01)

(52) U.S. Cl.
CPC . *B67B 3/24* (2013.01); *B67B 7/20* (2013.01)

(58) Field of Classification Search
CPC ..... B65B 31/046; B65B 3/24; B65B 7/20; A47G 19/2272; B65D 79/005; B65D 1/0253; B65D 81/2038; B65D 41/32; B65D 41/34; B65D 41/3442; B65D 47/00; B65D 47/12; B65D 47/122; B65D 51/1661; B65D 51/1644; B65D 51/1633; B65D 51/16; B65D 2205/00
USPC ..... 53/405; 215/307, 311; 220/367.1, 373
See application file for complete search history.

(56) References Cited

U.S. PATENT DOCUMENTS 2,624,220 A 1/1953 Cassiere et al.
4,372,096 A 2/1983 Baum
4,660,355 A * 4/1987 Kristen ..... B65B 31/047 215/277

(Continued)

OTHER PUBLICATIONS

Secrest of a Vacuum-Packer: 10 Tips for Getting Lids to Seal on a Mason Jar Salad in a Jar [online]. Apr. 5, 2013. Retreived on Apr. 29, 2018. 6 pages.

*Primary Examiner* — Anna K Kinsaul
*Assistant Examiner* — Daniel Jeremy Leeds
(74) *Attorney, Agent, or Firm* — GSS Law Group; Gregory S. Smith; Philip P. Wagner

(57) ABSTRACT

An apparatus for vacuum-sealing a lid onto a jar includes a cap skirt joined to a cap. The cap and cap skirt are formed with internal threads for engaging corresponding external threads on the jar. A lid for the jar placed against the lid press will be drawn against the rim of the jar after air is pumped out of the jar through the cap. An airtight seal is established between the lid and the rim of the jar when air at normal atmospheric pressure enters the vacuum port, the pressure difference between the outside and inside of the jar forcing the lid onto the jar rim and sealing the jar. A prying plate positioned on the top of the cap permits removal of the lid without deforming the lid beyond its elastic limit, enabling lids to be removed and re-sealed against the jar.

12 Claims, 6 Drawing Sheets

SECTION A-A

(56) References Cited

U.S. PATENT DOCUMENTS

| | | | | |
|---|---|---|---|---|
| 5,228,274 | A * | 7/1993 | De Man | B67B 3/24 426/404 |
| 5,406,992 | A * | 4/1995 | Miramon | A47G 19/2272 141/64 |
| 9,359,117 | B2 * | 6/2016 | Russell | B65D 51/1661 |
| 9,994,379 | B2 * | 6/2018 | Russell | B29C 43/146 |
| 2012/0199582 | A1 * | 8/2012 | Cai | B65D 21/0209 220/203.04 |
| 2014/0263151 | A1 * | 9/2014 | Russell | B65D 51/145 215/44 |
| 2015/0158708 | A1 | 6/2015 | Hager | |
| 2018/0155096 | A1 * | 6/2018 | Pan | B65D 51/243 |

* cited by examiner

SECTION A-A

SECTION B-B

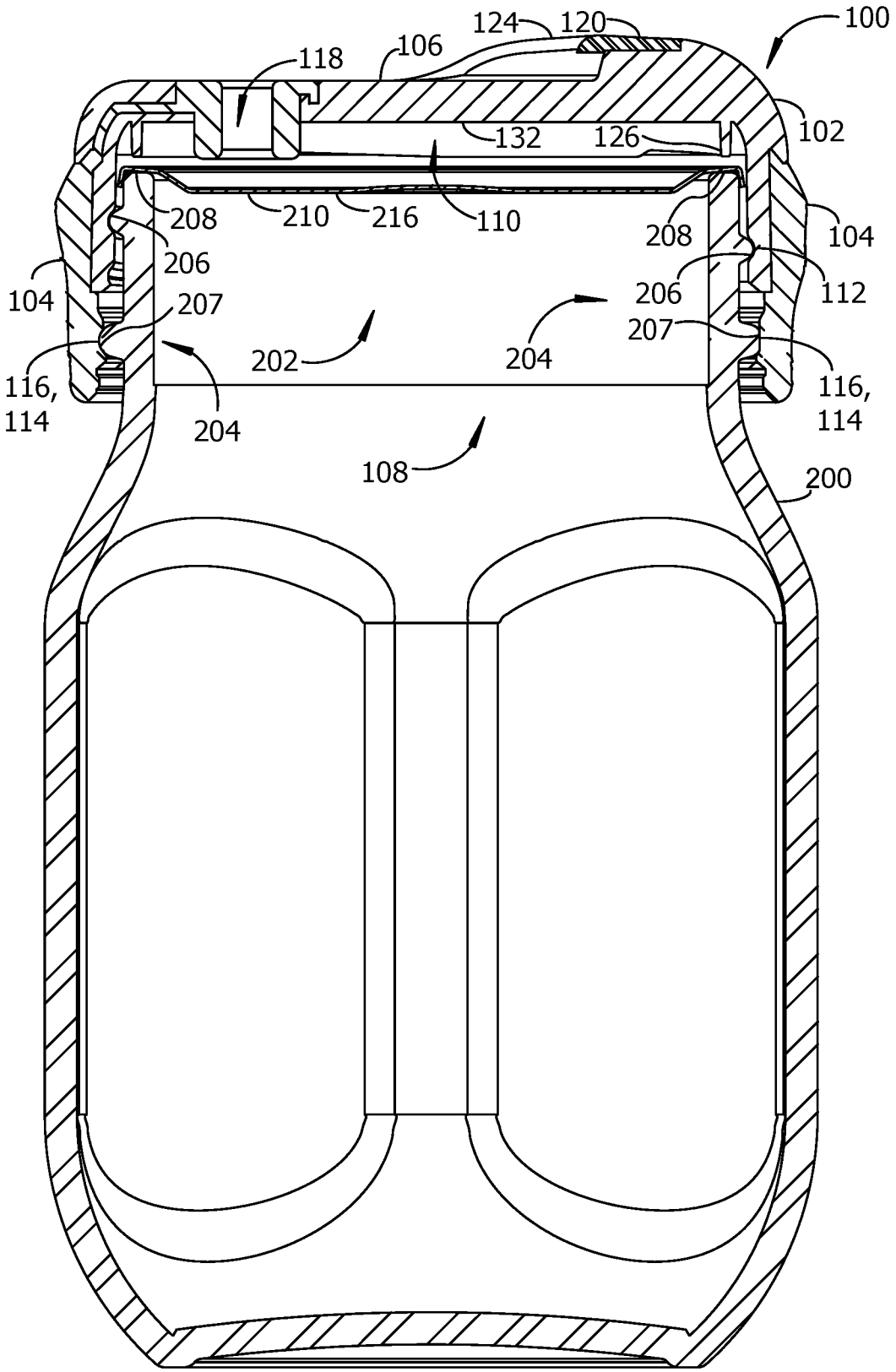
Fig. 9 SECTION C-C

JAR SEALING AND UNSEALING DEVICE

CROSS REFERENCE TO RELATED APPLICATIONS

This application claims priority to U.S. Provisional Patent Application No. 62/467,424, titled "Jar Device With Opener", filed Mar. 6, 2017, incorporated herein by reference in its entirety.

FIELD OF THE INVENTION

Embodiments of the invention are related generally to equipment for vacuum sealing of containers.

BACKGROUND

A molded glass jar sometimes referred to as a Mason jar has long been a popular means for storing food and non-food items. A Mason jar may be formed with an external thread near the mouth of the jar. A circumferential ridge may extend outward from the jar below the external thread. The circumferential ridge, which may be referred to as a bead, may be positioned on the neck of the jar above the shoulder, where the neck flares into the body of the jar. The jar may be closed by placing a disc-shaped metal lid against the rim surrounding the mouth of the jar and clamping the lid to the jar with an internally-threaded metal ring. The metal ring, also referred to as a band, may have a circumferential flange positioned to press against the top surface of the lid, holding the lid tightly to the jar when the internal threads on the band are tightened against the corresponding external threads on the jar.

A circumferential sealing gasket may be molded onto the bottom side of the lid near the lid's perimeter. The sealing gasket may be made from a food-safe polymer material capable of withstanding boiling water, steam, and other agents used to sanitize the jar, lid, and band. The sealing gasket may be positioned on the lid to contact the rim of the jar mouth, preferably forming an airtight and liquid-tight seal against the rim when the band is tightened onto the jar.

Home canning processes for preserving food in Mason jars cause the interior of a jar sealed by a lid and band to be at a lower gas pressure than ambient atmospheric pressure. The pressure differential between the interior and exterior of the jar seals the lid's gasket tightly against the jar's rim. Prying the lid away from the rim breaks the airtight seal, possibly allowing the contents of the jar to leak out and/or air to leak in. The contents of the jar may be degraded by exposure to damp or dusty air, or volatile components of the contents may escape from a jar with an unsealed lid. Prying a lid away from a jar rim with a person's fingers, a bottle cap lifter, the blade of a knife or a similar tool may bend the lid beyond its elastic limit, deforming the gasket surface and rendering the lid unsuitable for sealing a jar.

Devices have been developed for attaching a lid to a Mason jar by reducing gas pressure inside the jar with a vacuum pump. The lid may be placed in a cap or holder providing a fluid path from a vacuum port to the inside of the jar. Pumping air out of the jar through the vacuum port reduces gas pressure inside the jar. The lid may be secured to the jar when the fluid path between the vacuum port and lid is vented to ambient atmospheric pressure and the pressure differential presses the gasket on the lid onto the rim.

Vacuum sealing devices previously known in the art are pushed over the open mouth of the jar, relying on contact between a gasket material and the threads and/or outer surface of the jar to establish an airtight seal. Without an airtight seal, a vacuum pump may draw air from outside the jar rather than from the interior of the jar, possibly failing to reduce the internal gas pressure in the jar sufficiently to hold the lid securely. A person using a push-on vacuum sealing device may find it difficult to force the push-on cap over the jar threads with sufficient force to establish an airtight seal, or may have to remove the cap and re-install it more than once before the vacuum pump withdraws enough air from inside the jar to establish an airtight seal with the lid. Unless a sufficient pressure differential is developed by use of the push-on device, the lid may not be secure and the contents of the jar may not be protected by an airtight and/or liquid-tight seal.

SUMMARY

An apparatus for forming an airtight seal between a metal lid and a jar includes a cap having a top surface; a circumferential cap skirt attached to the cap, the cap skirt extending downward along an outer edge of said cap; a vacuum port formed in the top surface, the vacuum port in fluid communication with a plenum formed inside the apparatus; and a lid press extending from the cap into the plenum, the lid press positioned to limit displacement of the lid into the plenum. An optional prying plate may be attached to the cap above the top surface, the prying plate positioned to engage an outer edge of the lid when the lid is in contact with the top surface. The cap skirt and the cap are each formed with an internal thread positioned for engagement with a corresponding external thread on the jar. The cap skirt is formed from a flexible material capable of forming an airtight seal against an external circumferential ridge below the threads on the jar.

The optional prying plate includes a bottom edge. A separation distance between the bottom edge and the top surface of the cap is slightly greater than a thickness dimension of the lid. The prying plate may be attached to a pad extending upward from the top surface. The pad may be formed with an arcuate wall positioned to stop lateral displacement of the lid toward the prying plate.

BRIEF DESCRIPTION OF THE DRAWINGS

FIG. 9 is a cross-sectional view C-C of the example of a jar sealer and glass jar of FIG. 8. FIG. 9 further illustrates an example of a lid sealed to the rim of the jar by operation of the jar sealer. A position and viewing direction for the cross-sectional view is marked by a section line C-C in FIG. 8.

DESCRIPTION

An apparatus for vacuum-sealing a metal lid onto a jar forms an airtight and water-tight seal between the lid and the rim surrounding the mouth of the jar. The apparatus, also referred to herein as a jar sealer, includes a prying plate for safely and efficiently unsealing a lid from a jar without damaging the lid. A jar sealer in accord with the disclosed embodiments enables lids to be reused many times for sealing items into a jar. Items sealed into a jar through use of a jar sealer embodiment are protected from moisture and contaminants outside the jar. Food items sealed into a jar retain volatile organic compounds associated with good flavor and aroma.

Unlike previously known vacuum sealing devices, a jar sealer embodiment reliably establishes an airtight seal against the external threads of a nonporous container such as a Mason jar, with little physical effort or dexterity required of the person installing the jar sealer on a jar. An optional prying plate on the top side of the jar sealer is positioned to gently lever the outer edge of the lid away from the rim of the jar, breaking the vacuum seal and enabling easy removal of the lid from the jar. The spacing between the prying plate and the top of the jar sealer has been selected to limit the amount of bending deflection of the lid to a value below the elastic deformation limit of the lid material, thereby permitting the lid to return to its original shape after being removed from the jar.

Figure 1:
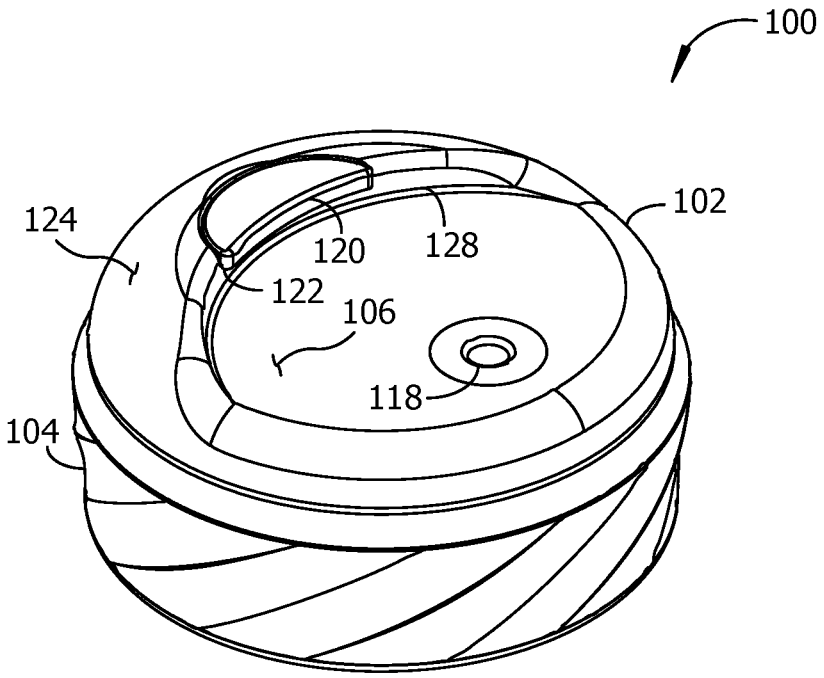
FIG. 1 is a pictorial view toward the top and side of an example of a jar sealer in accord with an embodiment.

FIG. 1 shows a pictorial view of an example of a jar sealer 100. The example jar sealer 100 includes a cap 102 having a raised pad 124 projecting above a flat top surface 106. In some embodiments, the cap is made from a rigid material, although a flexible material may alternately be used. An optional lid prying plate 120 may be strongly attached to the raised pad 124, with a bottom side 122 of the prying plate 120 spaced above the top surface 106 by a distance slightly greater than the thickness of a lid. The large contact area of the top surface 106 and the preferred spacing of the prying plate from the top surface reduce bending of a lid being unsealed from a jar, allowing the lid to return to its original shape after being removed from the jar. An arcuate wall 128 joining the raised pad 124 to the top surface 106 functions as a position limit for a lid placed against the jar sealer 100 while the lid is being unsealed. The arcuate wall prevents lateral motion of the lid parallel to the flat surface 106, toward the prying plate 120, thereby improving engagement between the prying plate and lid when ajar is to be unsealed.

As shown in FIG. 1, a cap skirt 104 extends downward from the cap 102. As suggested in FIG. 2, the cap skirt 104 extends all the way around the perimeter of the cap 102. While the cap 102 may be made from a rigid material such as ABS, reinforced nylon, polyethylene, or metal, the cap skirt 104 is preferably made from a flexible material soft enough to form an airtight seal against the curved exterior surface and/or circumferential ridge below the external threads on the neck of a Mason jar. Furthermore, the material of the cap skirt must be strong enough to support internal threads 114 formed on the interior surface of the cap skirt 104. The threads 114 formed on the interior surface of the cap skirt and internal threads 112 on the inside of the cap 102 are configured to engage with the corresponding external threads near the mouth of a Mason jar. Silicone rubber is an example of a material suitable for use in the cap skirt 104, although other materials may be used.

Figure 3:
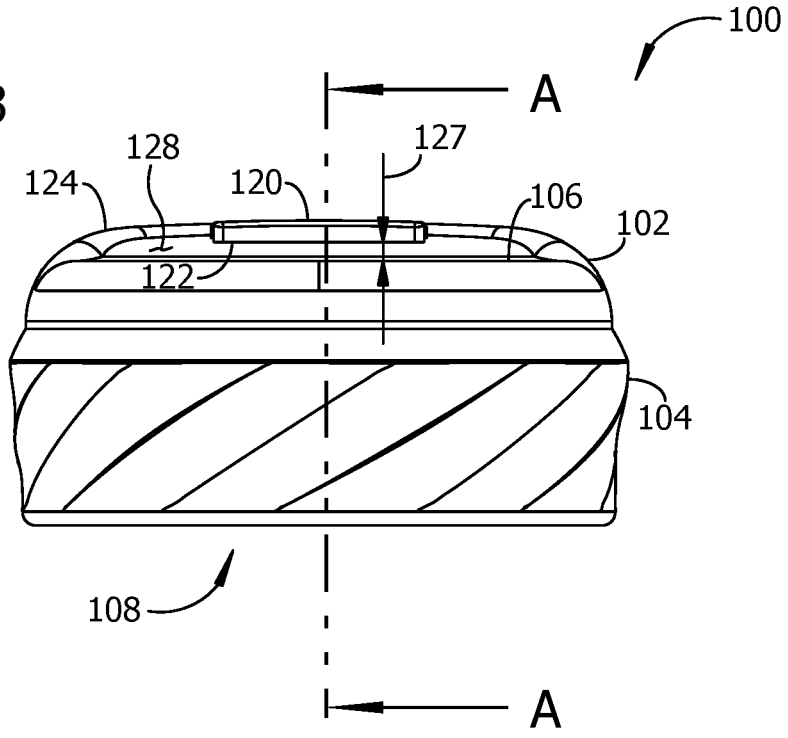
FIG. 3 is a side view of the example of a jar sealer of FIG. 1.

An example of a preferred separation distance 127 between the bottom side 122 of the prying plate 120 and the top surface 106 of the cap 102 is shown in a view toward the side of a jar sealer 100 in FIG. 3. A prying plate may be omitted from some embodiments of a jar sealer 100.

A prying plate 120 may optionally be provided as part of a jar lid opener 121 separately from a jar sealer 100. The prying plate 120 on a separate jar lid opener 121 will preferably have a preferred separation distance 127 between the bottom side 122 of the prying plate 120 and a top surface 106 of the jar lid opener, similar to the prying plate positioning shown in the example of FIGS. 1, 2, 3, and 5. The example of a raised pad 124 in the figures, or alternately the prying plate 120, may be shaped into a comfortable handle for holding a jar lid opener 121.

Figure 2:
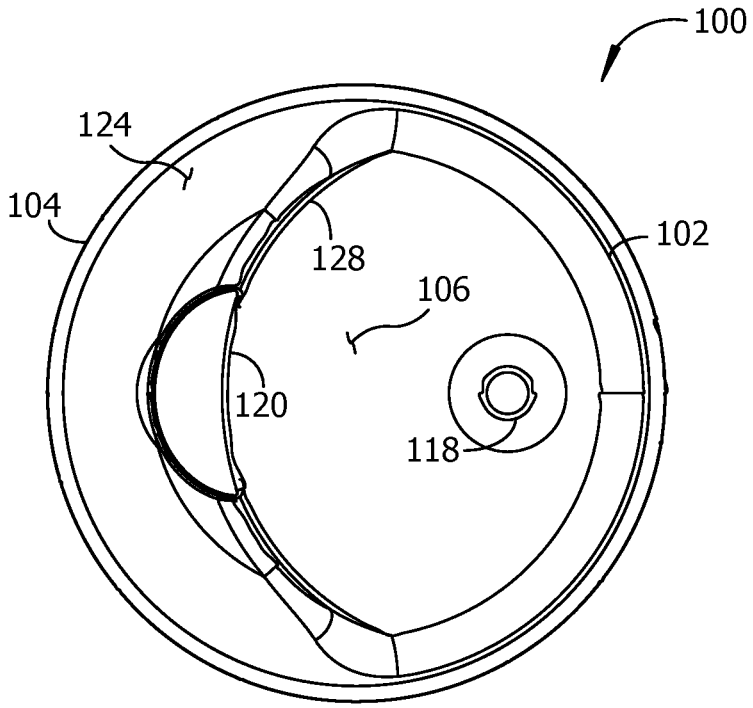
FIG. 2 is a view toward the top side of the example of a jar sealer of FIG. 1.
Figure 4:
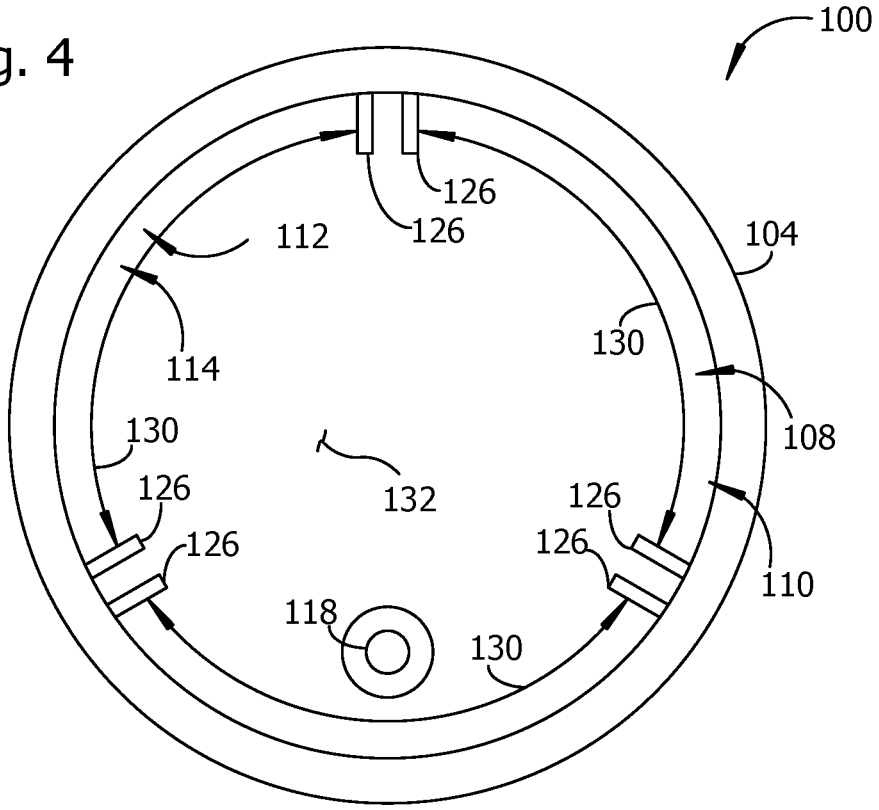
FIG. 4 is a view toward the open bottom side and plenum of the example of a jar sealer of FIG. 1.

An example of a vacuum port 118 is shown in FIGS. 1, 2, and 4. The vacuum port 118 may be formed as an aperture through the top surface 106, passing into a plenum 110 visible through the open bottom side 108 of the jar sealer 100 in the example of FIG. 4. A vacuum pump (not illustrated) may be attached to the vacuum port 118 by a hose or tube to draw air from the plenum 110 out through the vacuum port or allow air into the plenum when the vacuum port is opened to the atmosphere outside the jar sealer 100, for example by unplugging the hose from the vacuum port.

Also visible in the example of FIG. 4 are three sets of lid presses 126 positioned to limit vertical displacement of a lid relative to the rim of the jar to which the jar sealer 100 is attached. An embodiment 100 may alternatively have one, two, or more of the lid press 126, singly or in pairs. Limiting vertical displacement of the lid prevents the lid from bending past its elastic limit during vacuum pumping of the jar through the vacuum port. The lid presses 126 also prevent the lid from moving too far from the jar rim during vacuum pumping, without holding the lid firmly against the rim, so that air can be withdrawn from the interior of the jar and the lid can quickly seat against the jar rim when pumping stops and the vacuum port is vented to normal atmospheric pressure. While removing air through the vacuum port 118, an edge of the jar lid may flex upwards, away from the rim of the jar, thereby allowing air to be withdrawn from inside the jar. In the example of FIG. 4, three sets of lid presses 126 extend downward from an inner surface 132 of the plenum 110. The sets of lid presses 126 may be spaced at regular intervals 130 around the periphery of the plenum 110, close to the cap skirt 104.

The internal thread 112 on the cap 102 and the internal thread 114 on the cap skirt 104 are preferably configured to prevent the lid press 126 from pressing the jar lid 210 firmly against the rim 208 of the jar 200. If the threads (112, 114) were to allow the cap and cap skirt to hold the jar lid firmly onto the jar rim, the lid might not flex upwards enough and air might not be withdrawn from inside the jar when a vacuum line pulls air through the vacuum port. If the threads (112, 114) positioned the jar sealer 100 such that the inner surface 132 of the plenum 110 is too far above the jar rim, the jar lid might bend too much or may not seal against the jar rim before air leaks back into the jar after the vacuum source is disconnected from the jar sealer. Because of substantial variations in thread dimensions and positions on different jars, and variations in flexibility of jar lids, some experimentation was needed to find the optimum position of the lid presses for limiting the vertical displacement of jar lids inside the jar sealer 100, the number of thread turns in the cap and cap skirt, and the flexibility of the cap skirt.

Figure 5:
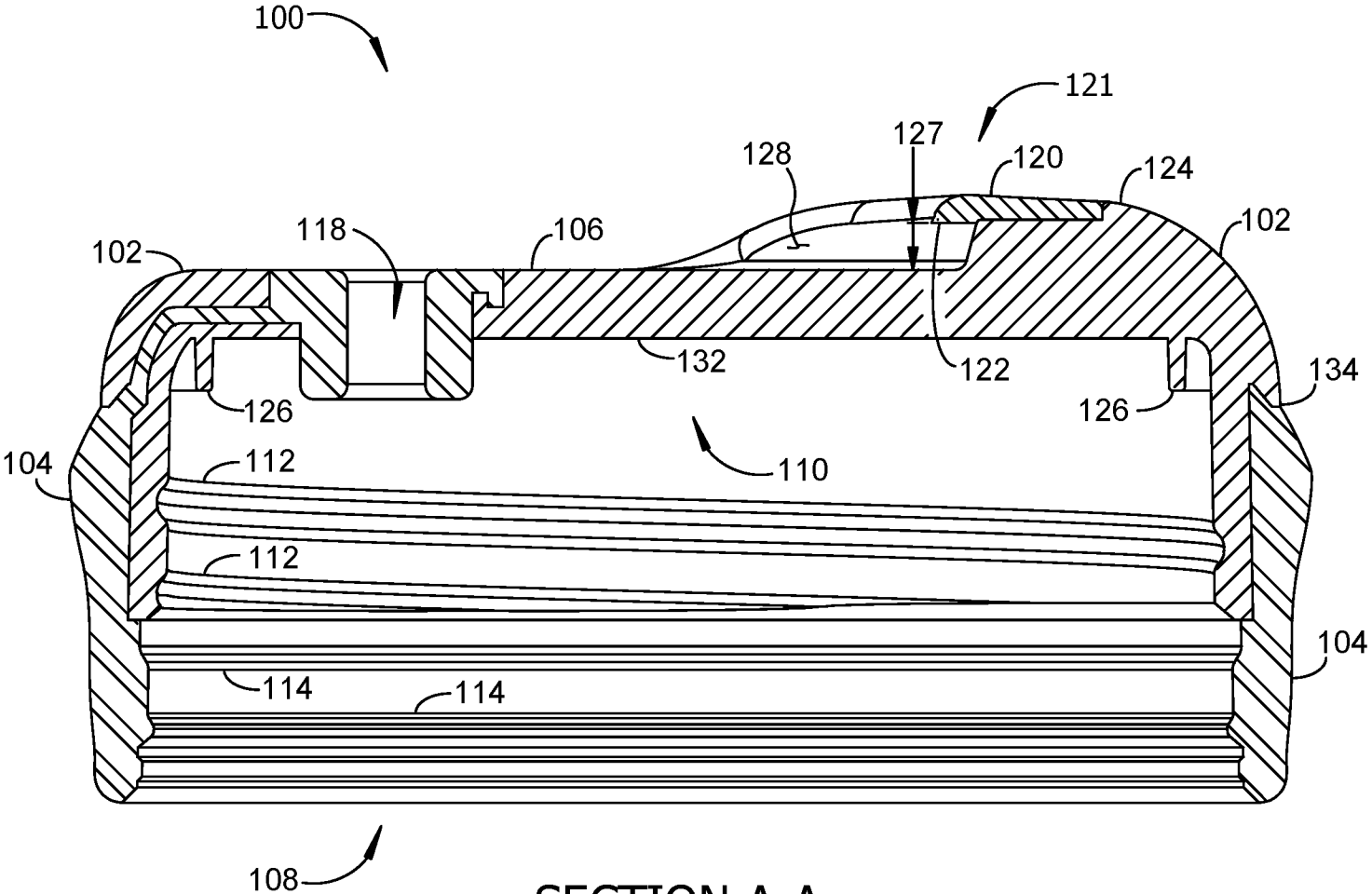
FIG. 5 is a cross-sectional view A-A of the example of a jar sealer from FIGS. 1-4. A position and viewing direction for the cross-sectional view is marked by a section line A-A in FIG. 3.

Additional details of an example jar sealer 100 are shown in FIG. 5. The vacuum port 118 penetrates the top surface 106, opening into the plenum 110 in the interior of the cap 102. The cap skirt 104 extends downward from the cap 102 along an outer edge 134 of the cap. Both the cap and the cap skirt are formed with internal threads (112, 114). The internal thread 112 on the cap 102 and the internal thread 114 on the cap skirt 104 form a continuous thread for engaging the corresponding external thread on the jar. The jar lid opener 121 on the top of the jar sealer 100 includes the lid prying plate 120 affixed to the raised pad 124 a preferred separation distance 127 above the top surface 106 of the jar sealer 100.

Figure 6:
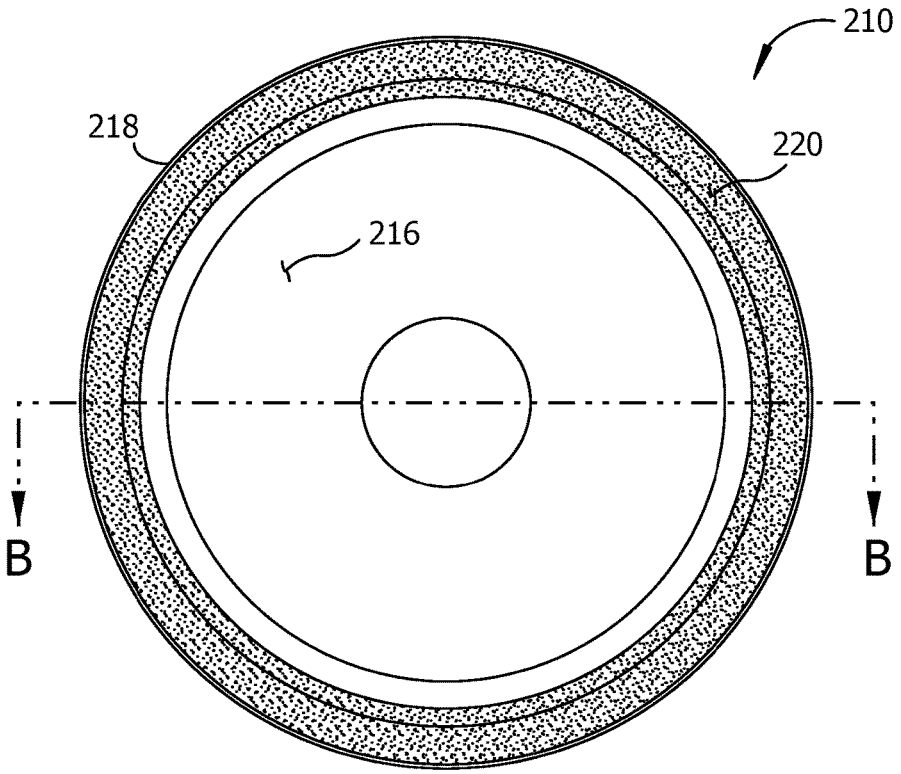
PRIOR ART Fig. 6
FIG. 6 is a view toward the bottom side of an example of a metal lid for a Mason jar (PRIOR ART).
Figure 7:
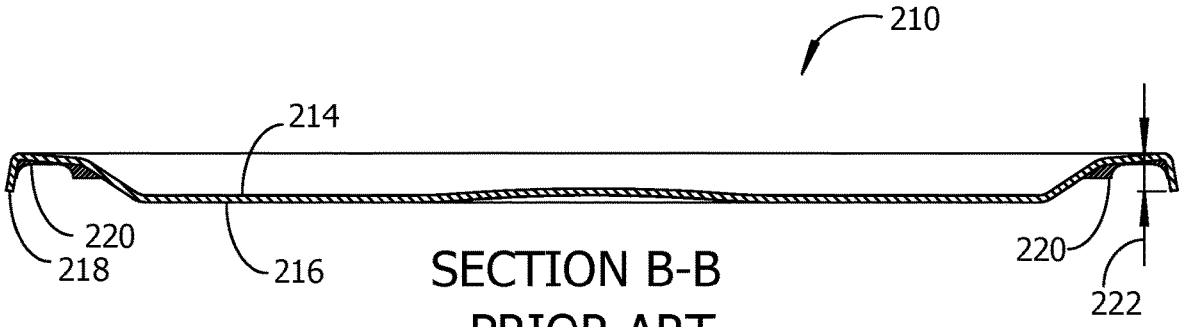
PRIOR ART Fig. 7
FIG. 7 is a cross-sectional view B-B of the example of a lid from FIG. 5. A position and viewing direction for the cross-sectional view is marked by a section line B-B in FIG. 6 (PRIOR ART).

FIGS. 6 and 7 show some features of an example of a lid 210 suitable for use with a jar sealer embodiment 100. The example lid 210 in FIG. 6 includes a lid gasket 220 (represented by a stippled area in FIG. 6) on the bottom side 216 of the lid 210. The lid gasket 220 is close to an edge flange 218 surrounding the perimeter of the lid 210. The edge flange 218 bends away from the top side 214 of the jar lid 210 and toward the bottom side 216. The bottom side 216 faces the interior of a jar when the lid 210 is sealed to the jar. The edge flange 218 guides the gasket 220 into position for sealing against the rim of a jar. A thickness dimension 222 of the lid is slightly less than the preferred separation distance of the prying plate 120 from the top surface 106 of the jar sealer 100.

Figure 8:
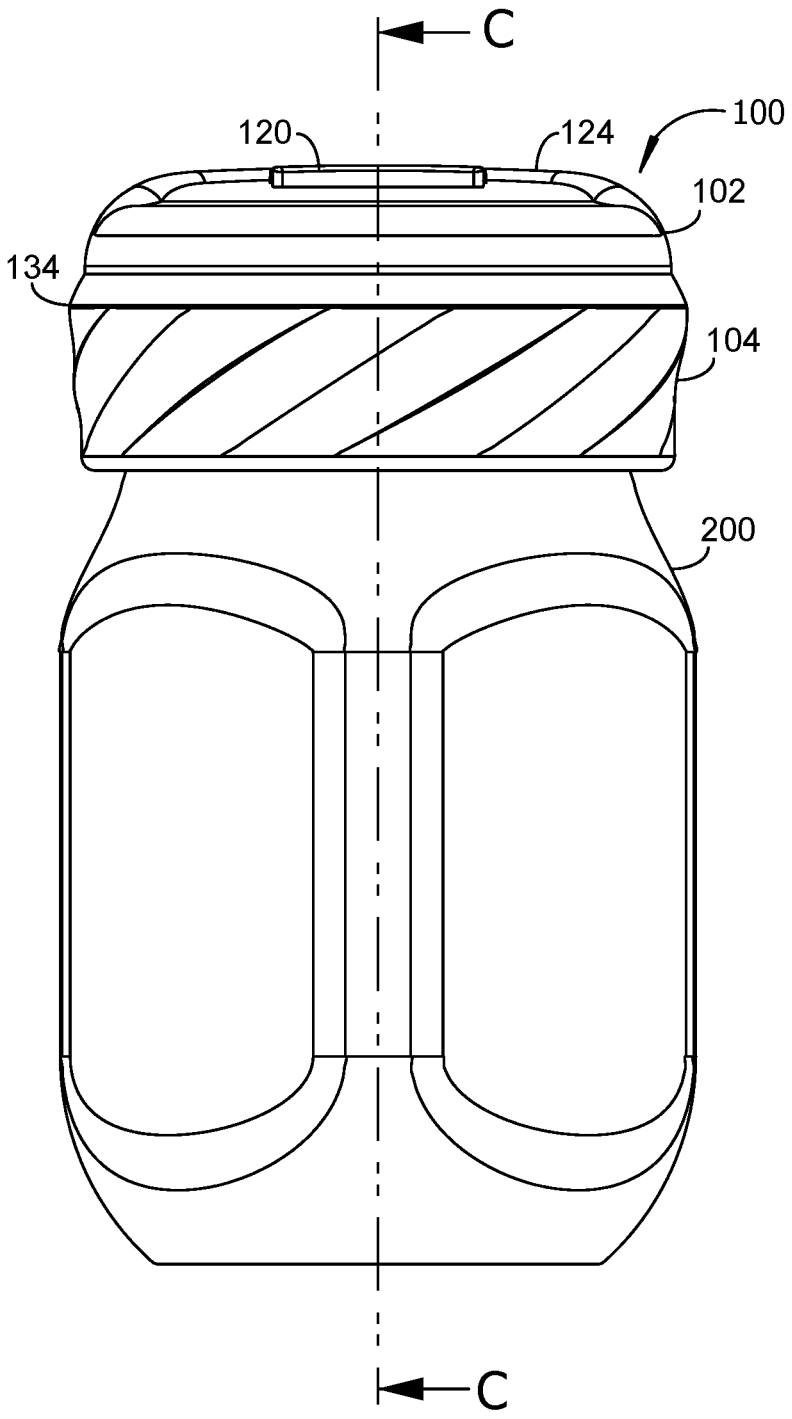
FIG. 8 is a side view of the example of a jar sealer from the previous figures installed on an example of a glass jar.

An example of a jar sealer 100 installed on a Mason jar 200 for sealing a jar lid to the jar is shown in a side view in FIG. 8 and in a cross-sectional view C-C in FIG. 9. The gasket 220 on the bottom side 216 of a lid 210 contacts the rim 208 surrounding the opening or mouth 202 on the neck 204 of a Mason jar 200. Internal threads (112, 114) on the cap 102 and cap skirt 104 engage corresponding external threads 206 on the neck 204 of the jar 200, setting the height of the plenum 110 and limiting the vertical travel and deflection of the jar lid 210. Close contact between the cap skirt 104 and the circumferential ridge 207 below the external threads 206 on the jar 200 form an airtight seal 116 to the cap skirt 104 all the way around the jar 200. The flexible material of the cap skirt allows the cap skirt to conform to small variations in the circumferential ridge 207 to form an airtight seal 116. When vacuum pumping is in operation, part of the lid 210 may be pulled toward, and possibly against, the lid presses 126, allowing air to be withdrawn from the inside of the jar. When pumping stops and the vacuum port is vented to ambient atmospheric pressure, the jar lid 210 quickly returns to its original shape and seats against the rim 208 of the jar with an airtight and watertight seal of the interior of the jar. The jar sealer 100 may be rotated to remove it from the jar 200 after the lid is sealed to the jar. The lid may be removed from the jar by inverting the lid from its orientation shown in FIG. 9, catching the edge of the sealed lid 210 with the prying plate 120, and rocking the lid gently to break the vacuum seal between the lid and the jar 200.

An example of a method embodiment includes any one or more of the following steps, singly or in any combination or sub-combination:

- placing a jar lid against a rim of a mason jar;
- threading a jar sealer onto the mason jar;
- removing air from the interior of the jar through a vacuum port in the jar sealer; and
- removing the jar sealer from the mason jar after the jar lid seals onto the jar.

The method embodiment may optionally include removing a sealed jar lid from a jar with a jar lid opener on the jar sealer.

The method embodiment may optionally include limiting an amount of bending of the jar lid during jar sealing to a value below an elastic deformation limit of the jar lid.

Unless expressly stated otherwise herein, ordinary terms have their corresponding ordinary meanings within the respective contexts of their presentations, and ordinary terms of art have their corresponding regular meanings.

The invention claimed is:

1. An apparatus for forming an airtight seal between a metal lid and ajar, comprising:

- a cap formed from a rigid material, said cap having a top surface, said cap formed with a first internal thread positioned for engagement with a corresponding external thread on said jar;
- a circumferential cap skirt attached to said cap, said cap skirt attached to said cap all the way around an outer edge of said cap, said cap skirt formed from a flexible material different from said rigid material of said cap, said flexible material soft enough to form an airtight seal against a circumferential ridge formed on said jar, said cap skirt formed with a second internal thread positioned for engagement with said external thread on said jar, said cap skirt extending to an open bottom side of said apparatus, and said cap not extending to said open bottom side;
- a vacuum port formed in said top surface, said vacuum port in fluid communication with a plenum formed by said cap and said cap skirt, and said vacuum port surrounded by said flexible material;
- a lid press extending from said cap into said plenum, said lid press positioned to limit displacement of said lid into said plenum; and
- a prying plate attached to said cap;
- wherein, when said cap skirt is positioned on said jar for forming said airtight seal, said cap is interposed between said cap skirt and said external thread on said jar, said cap does not extend to said circumferential ridge, said cap skirt is in contact with said circumferential ridge, and said airtight seal is formed between said cap skirt and said circumferential ridge.

2. The apparatus of claim 1, wherein said cap is formed with a separation distance between a bottom side of said prying plate and said top surface that is slightly greater than a thickness dimension of said lid.

3. The apparatus of claim 1, wherein said prying plate is attached to a pad extending away from said top surface.

4. The apparatus of claim 3, wherein said pad is formed with an arcuate wall.

5. The apparatus of claim 1, further comprising an additional plurality of said lid press arranged in three sets of two of said lid press, said three sets distributed at equal intervals around an inner surface of said plenum.

6. The apparatus of claim 1, further comprising a second lid press extending from said cap into said plenum.

7. The apparatus of claim 1, wherein said first internal thread on said cap and said second internal thread on said cap skirt form a continuous thread positioned for engaging said external thread on said jar.

8. The apparatus of claim 1, wherein said first internal thread on said cap and said second internal thread on said cap skirt are positioned to prevent said lid press from pressing said jar lid against a rim of said jar.

9. The apparatus of claim 1, wherein said rigid material comprises reinforced nylon.

10. The apparatus of claim 1, wherein said rigid material comprises polyethylene.

11. The apparatus of claim 1, wherein said rigid material comprises a metal.

12. The apparatus of claim 1, wherein said flexible material comprises silicone rubber.

* * * * *